US008500209B2

(12) United States Patent
Hall et al.

(10) Patent No.: US 8,500,209 B2
(45) Date of Patent: Aug. 6, 2013

(54) MANUALLY ROTATABLE TOOL

(75) Inventors: David R. Hall, Provo, UT (US); Ronald B. Crockett, Payson, UT (US); Gary Peterson, Provo, UT (US); Jeff Jepson, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 528 days.

(21) Appl. No.: 12/428,531

(22) Filed: Apr. 23, 2009

(65) Prior Publication Data

US 2009/0200857 A1 Aug. 13, 2009

Related U.S. Application Data

(63) Continuation-in-part of application No. 12/177,556, filed on Jul. 22, 2008, now Pat. No. 7,635,168, which is a continuation-in-part of application No. 12/135,595, filed on Jun. 9, 2008, now Pat. No. 7,946,656, which is a continuation-in-part of application No. 12/112,743, filed on Apr. 30, 2008, now Pat. No. 8,029,068, which is a continuation-in-part of application No. 12/051,738, filed on Mar. 19, 2008, now Pat. No. 7,669,674, which is a continuation-in-part of application No. 12/051,689, filed on Mar. 19, 2008, now Pat. No. 7,963,617, which is a continuation-in-part of application No. 12/051,586, filed on Mar. 19, 2008, now Pat. No. 8,007,050, which is a continuation-in-part of application No. 12/021,051, filed on Jan. 28, 2008, now Pat. No. 8,123,302, which is a continuation of application No. 12/021,019, filed on Jan. 28, 2008, which is a continuation-in-part of application No. 11/971,965, (Continued)

(51) Int. Cl.
*E21C 35/197* (2006.01)

(52) U.S. Cl.
USPC ..... 299/104; 299/106; 299/107

(58) Field of Classification Search
USPC ..... 299/102, 103, 107, 104, 106
See application file for complete search history.

(56) References Cited

U.S. PATENT DOCUMENTS 2,004,315 A 6/1935 Fean
2,124,438 A 7/1938 Struk (Continued)

FOREIGN PATENT DOCUMENTS

DE 3307910 9/1984
DE 3500261 7/1986

(Continued)

*Primary Examiner* — John Kreck
(74) *Attorney, Agent, or Firm* — Brinks Hofer Gilson & Lione

(57) ABSTRACT

A degradation assembly comprises a rotary portion and a stationary portion. The rotary portion includes a cemented metal bolster bonded to a tip. The tip comprises a symmetric, substantially conically shaped tip formed of diamond and a cemented metal carbide substrate. The stationary portion comprises a holder configured to be coupled to a block mounted to a driving mechanism. A compressible element is disposed intermediate, or between, and in mechanical contact with both the rotary portion and the stationary portion.

13 Claims, 13 Drawing Sheets

Related U.S. Application Data filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 3,254,392 | A | 6/1966 | Novkov | |
| 3,746,396 | A | 7/1973 | Radd | |
| 3,801,158 | A * | 4/1974 | Radd et al. | 299/104 |
| 3,807,804 | A | 4/1974 | Kniff | |
| 3,830,321 | A | 8/1974 | McKenry | |
| 3,932,952 | A | 1/1976 | Helton | |
| 3,945,681 | A | 3/1976 | White | |
| 4,005,914 | A | 2/1977 | Newman | |
| 4,006,936 | A | 2/1977 | Crabiel | |
| 4,098,362 | A | 7/1978 | Bonnice | |
| 4,109,737 | A | 8/1978 | Bovenkerk | |
| 4,156,329 | A | 5/1979 | Daniels | |
| 4,199,035 | A | 4/1980 | Thompson | |
| 4,201,421 | A | 5/1980 | Den Besten | |
| 4,268,089 | A | 5/1981 | Spence | |
| 4,277,106 | A | 7/1981 | Sahley | |
| 4,439,250 | A | 3/1984 | Acharya | |
| 4,465,221 | A | 8/1984 | Schmidt | |
| 4,484,644 | A | 11/1984 | Cook et al. | |
| 4,484,783 | A | 11/1984 | Emmerich | |
| 4,489,986 | A | 12/1984 | Dziak | |
| 4,660,890 | A | 4/1987 | Mills | |
| 4,678,237 | A | 7/1987 | Collin | |
| 4,682,987 | A | 7/1987 | Brady et al. | |
| 4,684,176 | A | 8/1987 | Den Besten | |
| 4,688,856 | A | 8/1987 | Elfgen | |
| 4,725,098 | A | 2/1988 | Beach | |
| 4,728,153 | A | 3/1988 | Ojanen | |
| 4,729,603 | A | 3/1988 | Elfgen | |
| 4,765,686 | A | 8/1988 | Adams | |
| 4,765,687 | A | 8/1988 | Parrott | |
| 4,776,862 | A | 10/1988 | Wiand | |
| 4,836,614 | A | 6/1989 | Ojanen | |
| 4,850,649 | A | 7/1989 | Beach | |
| 4,880,154 | A | 11/1989 | Tank | |
| 4,921,310 | A | 5/1990 | Hedlund | |
| 4,932,723 | A | 6/1990 | Mills | |
| 4,940,288 | A | 7/1990 | Stiffler | |
| 4,944,559 | A | 7/1990 | Sionnet et al. | |
| 4,951,762 | A | 8/1990 | Lundell | |
| 5,007,685 | A | 4/1991 | Beach | |
| 5,011,515 | A | 4/1991 | Frushour | |
| 5,112,165 | A | 5/1992 | Hedlund | |
| 5,141,289 | A | 8/1992 | Stiffler | |
| 5,154,245 | A | 10/1992 | Waldenstrom | |
| 5,186,892 | A | 2/1993 | Pope | |
| 5,251,964 | A | 10/1993 | Ojanen | |
| 5,261,499 | A | 11/1993 | Grubb | |
| 5,303,984 | A | 4/1994 | Ojanen | |
| 5,332,348 | A | 7/1994 | Lemelson | |
| 5,415,462 | A | 5/1995 | Massa | |
| 5,417,475 | A | 5/1995 | Graham | |
| 5,447,208 | A | 9/1995 | Lund | |
| 5,503,463 | A | 4/1996 | Ojanen | |
| 5,535,839 | A | 7/1996 | Brady | |
| 5,542,993 | A | 8/1996 | Rabinkin | |
| 5,653,300 | A | 8/1997 | Lund | |
| 5,720,528 | A | 2/1998 | Ritchey | |
| 5,725,283 | A | 3/1998 | O'Neill | |
| 5,730,502 | A | 3/1998 | Montgomery | |
| 5,738,698 | A | 4/1998 | Kapoor | |
| 5,823,632 | A | 10/1998 | Burkett | |
| 5,837,071 | A | 11/1998 | Anderson | |
| 5,845,547 | A | 12/1998 | Sollami | |
| 5,875,862 | A | 3/1999 | Jurewicz | |
| 5,884,979 | A | 3/1999 | Latham | |
| 5,934,542 | A | 8/1999 | Nakamura | |
| 5,935,718 | A | 8/1999 | Demo | |
| 5,944,129 | A | 8/1999 | Jensen | |
| 5,967,250 | A | 10/1999 | Lund | |
| 5,992,405 | A | 11/1999 | Sollami | |
| 6,006,846 | A | 12/1999 | Tibbitts | |
| 6,019,434 | A | 2/2000 | Emmerich | |
| 6,044,920 | A | 4/2000 | Massa et al. | |
| 6,051,079 | A | 4/2000 | Andersson | |
| 6,056,911 | A | 5/2000 | Griffin | |
| 6,065,552 | A | 5/2000 | Scott | |
| 6,099,081 | A | 8/2000 | Warren et al. | |
| 6,113,195 | A | 9/2000 | Mercier | |
| 6,170,917 | B1 | 1/2001 | Heinrich et al. | |
| 6,176,552 | B1 * | 1/2001 | Topka et al. | 299/104 |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,270,165 | B1 | 8/2001 | Peay | |
| 6,341,823 | B1 | 1/2002 | Sollami | |
| 6,354,771 | B1 | 3/2002 | Bauschulte | |
| 6,357,832 | B1 | 3/2002 | Sollami | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen et al. | |
| 6,481,803 | B2 | 11/2002 | Ritchey | |
| 6,499,547 | B2 | 12/2002 | Scott | |
| 6,508,516 | B1 | 1/2003 | Krammerer | |
| 6,517,902 | B2 | 2/2003 | Drake | |
| 6,585,326 | B2 | 7/2003 | Sollami | |
| 6,585,327 | B2 | 7/2003 | Sollami | |
| 6,644,755 | B1 | 11/2003 | Kammerer | |
| 6,672,406 | B2 | 1/2004 | Beuershausen | |
| 6,685,273 | B1 | 2/2004 | Sollami | |
| 6,692,083 | B2 | 2/2004 | Latham | |
| 6,702,393 | B2 | 3/2004 | Mercier | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |

| | | | |
|---|---|---|---|
| 6,861,137 | B2 | 3/2005 | Griffin |
| 6,889,890 | B2 | 5/2005 | Yamazaki et al. |
| 6,962,395 | B2 | 11/2005 | Mouthaan |
| 6,966,611 | B1 | 11/2005 | Sollami |
| 6,994,404 | B1 | 2/2006 | Sollami |
| 7,204,560 | B2 | 4/2007 | Mercier |
| 7,413,256 | B2 | 8/2008 | Hall et al. |
| 7,992,944 | B2 | 8/2011 | Hall et al. |
| 2002/0070602 | A1 | 6/2002 | Sollami |
| 2002/0074851 | A1 | 6/2002 | Montgomery |
| 2002/0153175 | A1 | 10/2002 | Ojanen |
| 2002/0175555 | A1 | 11/2002 | Mercier |
| 2003/0015907 | A1 | 1/2003 | Sollami |
| 2003/0137185 | A1 | 7/2003 | Sollami |
| 2003/0141350 | A1 | 7/2003 | Noro |
| 2003/0141753 | A1 | 7/2003 | Peay |
| 2003/0209366 | A1 | 11/2003 | McAlvain |
| 2003/0230926 | A1 | 12/2003 | Mondy |
| 2003/0234280 | A1 | 12/2003 | Cadden |
| 2004/0026983 | A1 | 2/2004 | McAlvain |
| 2004/0065484 | A1 | 4/2004 | McAlvain |
| 2005/0044987 | A1 | 3/2005 | Takayama et al. |
| 2005/0159840 | A1 | 7/2005 | Lin |
| 2005/0173966 | A1 | 8/2005 | Mouthaan |
| 2006/0125306 | A1 | 6/2006 | Sollami |
| 2006/0237236 | A1 | 10/2006 | Sreshta |
| 2008/0030065 | A1 * | 2/2008 | Frear ..... 299/104 |

FOREIGN PATENT DOCUMENTS

| | | |
|---|---|---|
| DE | 3818213 | 11/1989 |
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| GB | 2004315 | 3/1979 |
| GB | 2037223 | 11/1979 |
| JP | 5280273 | 10/1993 |
| JP | 3123193 | 1/2001 |

* cited by examiner

MANUALLY ROTATABLE TOOL

CROSS REFERENCE TO RELATED APPLICATIONS

This application is a continuation-in-part of U.S. patent application Ser. No. 12/177,556 filed on Jul. 22, 2008 and which is now U.S. Pat. No. 7,635,168 that issued on Dec. 22, 2009, which is a continuation-in-part of U.S. patent application Ser. No. 12/135,595 filed on Jun. 9, 2008 and which is now U.S. Pat. No. 7,946,656 that issued on May 24, 2011, which is a continuation-in-part of U.S. patent application Ser. No. 12/112,743 filed on Apr. 30, 2008 which is now U.S. Pat. No. 8,029,068 that issued on Oct. 4, 2011, which is a continuation-in-part of U.S. patent application Ser. No. 12/051,738 filed on Mar. 19, 2008 and is now U.S. Pat. No. 7,669,674 that issued on Mar. 2, 2010, which is a continuation-in-part of U.S. patent application Ser. No. 12/051,689 filed on Mar. 19, 2008 and is now U.S. Pat. No. 7,963,617 that issued on Jun. 21, 2011, which is a continuation-in-part of U.S. patent application Ser. No. 12/051,586 filed on Mar. 19, 2008 and which is now U.S. Pat. No. 8,007,050 issued on Aug. 30, 2011, which is a continuation-in-part of U.S. patent application Ser. No. 12/021,051 filed on Jan. 28, 2008 and which is now U.S. Pat. No. 8,123,302 issued on Feb. 28, 2012, which is a continuation of U.S. patent application Ser. No. 12/021,019 filed on Jan. 28, 2008, which is a continuation-in-part of U.S. patent application Ser. No. 11/971,965 filed on Jan. 10, 2008 and is now U.S. Pat. No. 7,648,210 that issued on Jan. 19, 2010, which is a continuation of U.S. patent application Ser. No. 11/947,644 filed on Nov. 29, 2007 and which is now U.S. Pat. No. 8,007,051 issued on Aug. 30, 2011, which is a continuation-in-part of U.S. patent application Ser. No. 11/844,586 filed on Aug. 24, 2007 and is now U.S. Pat. No. 7,600,823 that issued on Oct. 13, 2009. U.S. patent application Ser. No. 11/844,586 is a continuation-in-part of U.S. patent application Ser. No. 11/829,761 filed on Jul. 27, 2007 and is now U.S. Pat. No. 7,722,127 that issued on May 25, 2010. U.S. patent application Ser. No. 11/829,761 is a continuation-in-part of U.S. patent application Ser. No. 11/773,271 filed on Jul. 3, 2007 and which is now U.S. Pat. No. 7,997,661 issued on Aug. 16, 2011. U.S. patent application Ser. No. 11/773,271 is a continuation-in-part of U.S. patent application Ser. No. 11/766,903 filed on Jun. 22, 2007, which is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and is now U.S. Pat. No. 7,475,948 that issued on Jan. 13, 2009. U.S. patent application Ser. No. 11/742,304 is a continuation of U.S. patent application Ser. No. 11/742,261 filed on Apr. 30, 2007 and is now U.S. Pat. No. 7,469,971 that issued on Dec. 30, 2008. U.S. patent application Ser. No. 11/742,261 is a continuation-in-part of U.S. patent application Ser. No. 11/464,008 filed on Aug. 11, 2006 and is now U.S. Pat. No. 7,338,135 that issued on Mar. 4, 2008. U.S. patent application Ser. No. 11/464,008 is a continuation-in-part of U.S. patent application Ser. No. 11/463,998 filed on Aug. 11, 2006 and is now U.S. Pat. No. 7,384,105 that issued on Jun. 10, 2008. U.S. patent application Ser. No. 11/463,998 is a continuation-in-part of U.S. patent application Ser. No. 11/463,990 filed on Aug. 11, 2006 and is now U.S. Pat. No. 7,320,505 that issued on Jan. 22, 2008. U.S. patent application Ser. No. 11/463,990 is a continuation-in-part of U.S. patent application Ser. No. 11/463,975 filed on Aug. 11, 2006 and is now U.S. Pat. No. 7,445,294 that issued on Nov. 4, 2008. U.S. patent application Ser. No. 11/463,975 is a continuation-in-part of U.S. patent application Ser. No. 11/463,962 filed on Aug. 11, 2006 and is now U.S. Pat. No. 7,413,256 that issued on Aug. 19, 2008. The present application is also a continuation-in-part of U.S. patent application Ser. No. 11/695,672 filed on Apr. 3, 2007 and is now U.S. Pat. No. 7,396,086 that issued on Jul. 8, 2008. U.S. patent application Ser. No. 11/695,672 is a continuation-in-part of U.S. patent application Ser. No. 11/686,831 filed on Mar. 15, 2007 and is now U.S. Pat. No. 7,568,770 that issued on Aug. 4, 2009. All of these applications are herein incorporated by reference for all that they contain.

BACKGROUND OF THE INVENTION

Formation degradation, such as drilling to form a well bore in the earth, pavement milling, mining, and/or excavating, may be performed using degradation assemblies. In normal use, these assemblies and auxiliary equipment are subjected to high impact, heat, abrasion, and other environmental factors that wear their mechanical components. Many efforts have been made to improve the service life of these assemblies. In some cases it is believed that the free rotation of the impact tip of the degradation assembly aides in lengthening the life of the degradation assembly by promoting even wear of the assembly.

U.S. Pat. No. 5,261,499 to Grubb, which is herein incorporated by reference for all that it contains, discloses a two-piece rotatable cutting bit which comprises a shank and a nose. The shank has an axially forwardly projecting protrusion which carries a resilient spring clip. The protrusion and spring clip are received within a recess in the nose to rotatably attach the nose to the shank.

U.S. patent application Ser. No. 12/177,556 to Hall et al., which is herein incorporated by reference for all that it contains, discloses a degradation assembly comprises a shank with a forward end and a rearward end, the rearward end being adapted for attachment to a driving mechanism, with a shield rotatably attached to the forward end of the shank. The shield comprises an underside adapted for rotatable attachment to the shank and an impact tip disposed on an end opposing the underside. A seal is disposed intermediate, or between, the shield and the shank.

BRIEF SUMMARY OF THE INVENTION

In one aspect of the present invention, a tool assembly comprises a rotary portion and a stationary portion. The rotary portion comprises a bolster bonded to a diamond, symmetric, substantially conically shaped tip. The stationary portion comprises a block mounted to a driving mechanism. An indexing mechanism, such as a compressible element is disposed intermediate, or between, and in mechanical contact with both the rotary and stationary portions. The compressible element is compressed sufficiently to restrict free rotation during a degradation operation. In some embodiments, the compressible element is compressed sufficiently enough to prevent free rotation. The tool assembly may be a degradation assembly.

In some embodiments, the compressible element comprises an O-ring under 20%-40% compression. The O-ring may also comprise a hardness of 70-90 durometers. The compressible element may also act as a seal that retains lubricant within the assembly. The compressible element may comprise any of the following: at least one rubber ball, a compression spring, a set screw, a non-round spring clip, a spring clip with at least one flat surface, a press fit pin, or any combination thereof. A first rubber compressible element may be disposed on the stationary portion and be in contact with a second rubber compressible element disposed on the rotary portion.

In some embodiments, the rotary portion of the assembly may comprise a puller attachment and/or a wrench flat. The rotary portion may also comprise a shield, such that a recess of the shield is rotatably connected to a first end of the stationary portion. The bolster may also wrap around a portion of the stationary portion.

In some embodiments, the compressible element may comprise a metallic material. The compressible element may be part of a metal seal, which is tight enough to prevent restrict or prevent free rotation.

In another aspect of the present invention the assembly may comprise a holder. The holder may be part of either the stationary or the rotary portion of the assembly. The holder may comprise at least one longitudinal slot.

In one aspect of the present invention, a degradation assembly comprises a bolster intermediate, or between, a shank and a symmetric, substantially conical shaped tip. The tip comprises a substrate bonded to a diamond material. The diamond comprises an apex coaxial with the tip, the diamond being over 0.100 inches thick along a central axis of the tip. The shank is inserted into a holder attached to a driving mechanism. The assembly comprises a mechanical indexing arrangement, wherein the tip comprises a definite number of azimuthal positions determined by the mechanical indexing arrangement, each position orienting a different azimuth of the tip such that the different azimuth impacts first during an operation.

In some embodiments, the shank comprises substantially symmetric longitudinal flat surfaces. The shank may axially comprise a hexagonal shape, a star shape, or any other axially symmetric shapes. The shank may comprise an O-ring, a catch, a spring clip, or any combination thereof. The tip may be rotationally isolated from the shank.

In some embodiments, the bolster may comprise a puller attachment. The bolster may also be in communication with the driving mechanism through a press-fit pin.

In some embodiments, the assembly may comprise a holder. The holder may be indexable, and the holder may comprise a substantially axially symmetric geometry. The holder may be in coupled with the shank through a thread form. The holder may also comprise a spring loaded catch or a ratcheted cam.

In another aspect of the present invention, a method of utilizing a degradation assembly comprises providing a degradation assembly comprising a bolster intermediate, or between, a shank and a tip, the tip comprising a substrate bonded to a diamond material comprising a symmetric, substantially conical shape, the diamond comprising an apex coaxial with the tip, and the diamond being over 0.100 inches thick along the central axis of the tip. An operator actuates the driving mechanism for a first period of time. The operator rotates the degradation assembly along its central axis to another indexed azimuth and actuates the driving mechanism for a second period of time.

DETAILED DESCRIPTION OF THE INVENTION AND THE PREFERRED EMBODIMENT

Figure 1:
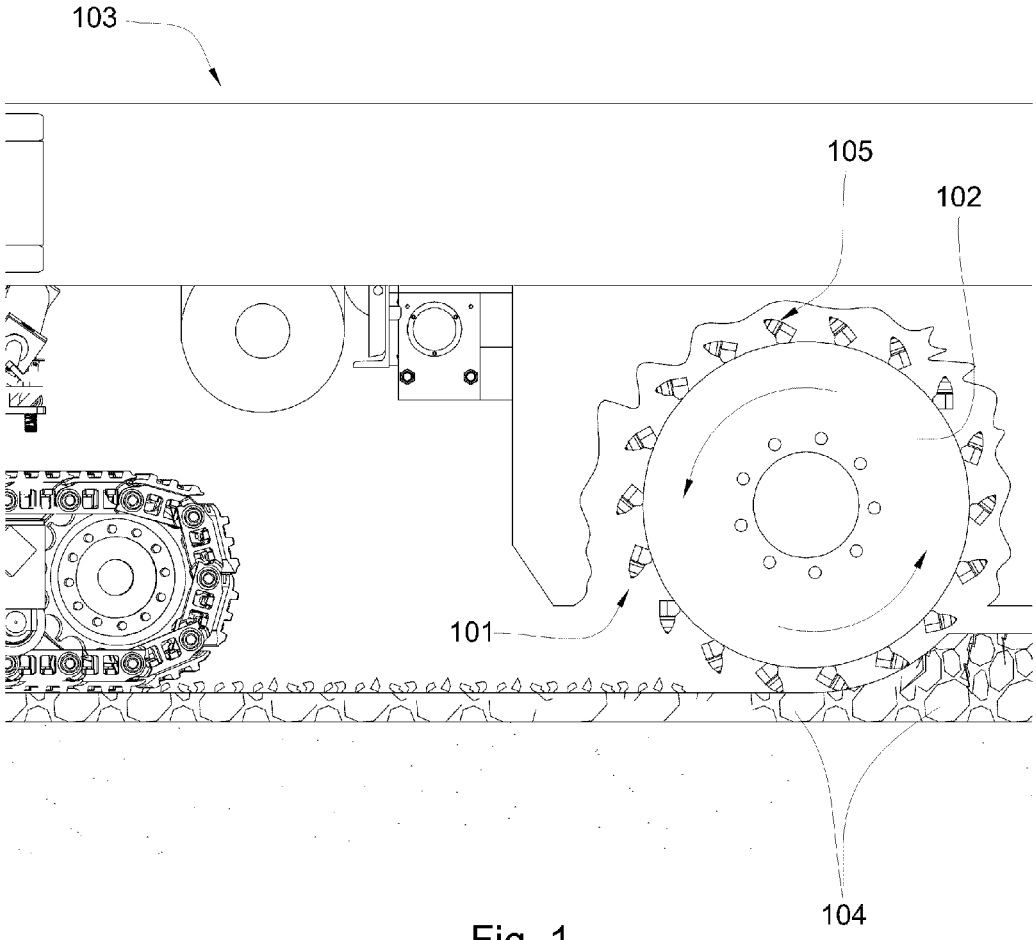
FIG. 1 is a cross-sectional diagram of an embodiment of a pavement milling machine.

FIG. 1 is a cross-sectional diagram that shows a plurality of degradation assemblies 101 attached to a driving mechanism 102, such as a rotatable drum attached to the underside of a pavement milling machine 103. The milling machine 103 may be an asphalt planer used to degrade man-made formations such as pavement 104 prior to placement of a new layer of pavement. The degradation assemblies 101 may be attached to the driving mechanism 102, bringing the degradation assemblies 101 into engagement with the formation 104. The degradation assembly 101 may be disposed within a block 105 welded or bolted to the drum attached to the driving mechanism 102. A holder may be disposed intermediate, or between, the degradation assembly 101 and the block 105. The block 105 may hold the degradation assembly 101 at an angle offset from the direction of rotation, such that the degradation assembly 101 engages the formation 104 at a preferential angle. While an embodiment of a pavement milling machine 103 was used in the above example, it should be understood that degradation assemblies disclosed herein have a variety of uses and implementations.

Figure 2A:
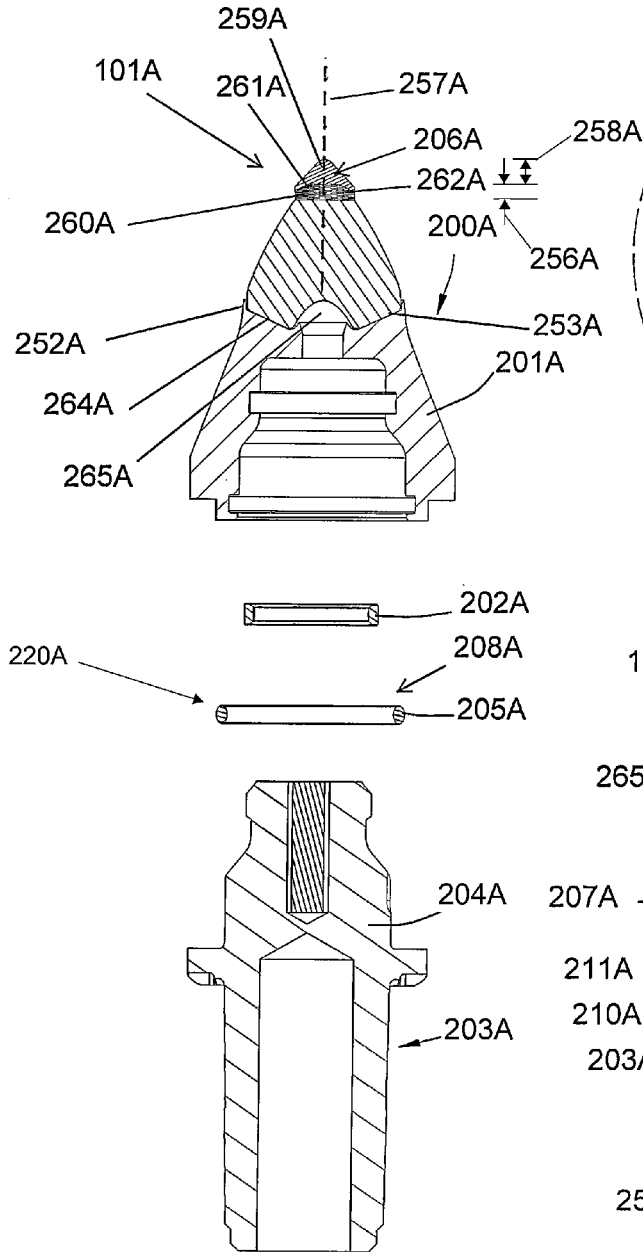
FIG. 2*a* is a cross-sectional and exploded diagram of an embodiment of a degradation assembly.

FIG. 2*a* is a cross-sectional exploded diagram of an embodiment of a degradation assembly 101A. In this embodiment the degradation assembly 101A comprises a rotary portion 200A in the form of a shield 201A and a stationary portion 203A in the form of a shank 204A. A conical diamond tip 206A may be bonded to the shield 201A. An indexing mechanism 220A, such as a compressible element 208A like O-ring 205A, may be adapted to be disposed intermediate, or between, the shield 201A and the shank 204A. A spring clip 202A may also be adapted to be disposed intermediate, or between, the shield 201 and the shank 204. The compressible element 208A may function as a grease barrier by maintaining grease between the shield 201A and the shank 204A.

Figure 2B:
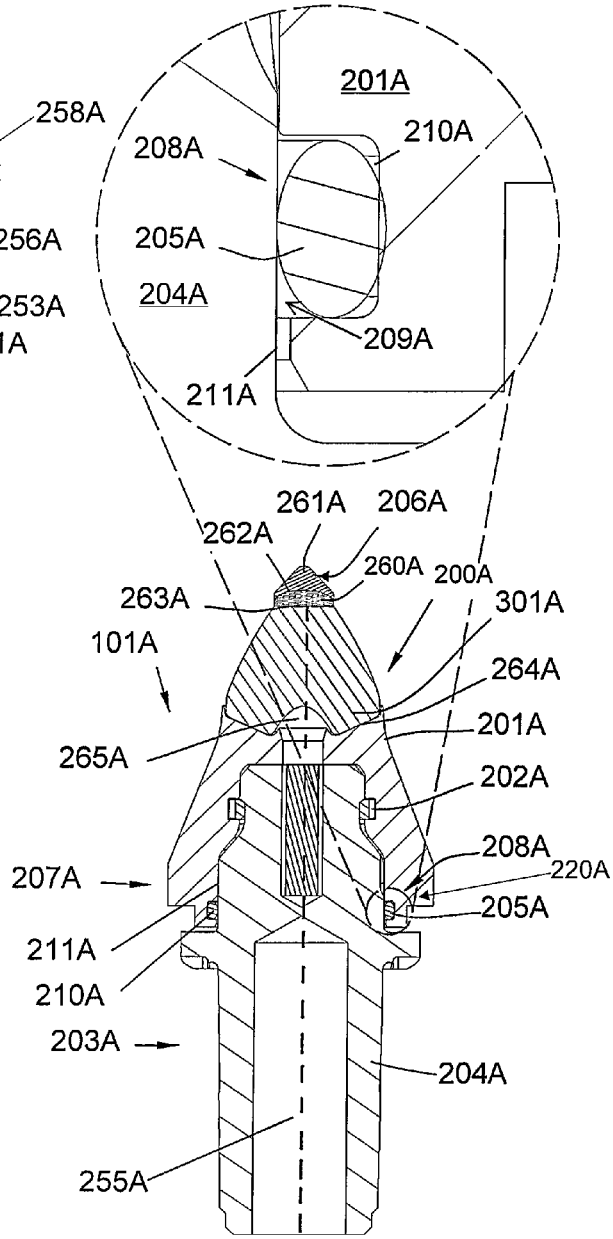
FIG. 2*b* is a cross-sectional diagram of the assembled degradation assembly illustrated in FIG. 2*a*.

The embodiment depicted in FIG. 2*b* discloses a cross-section of the assembled degradation assembly 101A illustrated in FIG. 2*a*. Assembled, the O-ring 205A is compressed 20%-40%. That is, the O-ring 205A may be under enough compression that it reduces the cross-sectional thickness of the O-ring 205A by 20%-40%. A space 209A between the shield 201A and shank 204A into which the O-ring 205A is disposed may be small enough to put the O-ring in such a compressed state. It is believed that an O-ring 204A compressed by 20%-40% by an inner surface 210A of the shield 201A and an outer surface 211A of the shank 204A may provide enough friction to prevent free rotation of the rotary portion 200A of the degradation assembly 101A during degradation operations.

The O-ring 205A may comprise a hardness of 70-90 durometers. The hardness of the O-ring 205A may influence the friction created between the O-ring 205A, the shank 204A, and the shield 201A and may also influence the durability and life of the O-ring 205A. The O-ring 205A may also function as a seal to retain a lubricant intermediate, or between, the shield 201A and the shank 204A.

In this embodiment, the degradation assembly 101A may be used in degradation operations until the tip 206A begins to show uneven wear or for a predetermined time period. The degradation assembly 101A may then be manually rotated such that a new azimuth of the tip 206A is oriented to engage a formation to be degraded, such as formation 104 in FIG. 1, first. A wrench flat 207 may be disposed on the rotary portion 200A of the degradation assembly 101A to allow the rotary portion 200A to be turned by a wrench.

The rotary portion 200A includes a tip 206A comprising a cemented metal carbide substrate 260A and a volume of sintered polycrystalline diamond 261A forming a substantially conical geometry with a rounded apex 259A (FIG. 2*a*). The sintered polycrystalline diamond 261A has a thickness 258A preferably from 0.100 to 0.250 inch from the apex 259A to an interface 262A between the substrate 260A and diamond 261A through a central, or tip, axis 257 of the sintered polycrystalline diamond 261A, as illustrated in FIG. 2*a*.

Preferably, the cemented metal carbide substrate 260A is brazed at a braze joint 263A to a cemented metal bolster 301A affixed to the shield 201A. The cemented metal carbide substrate 260A has a thickness 256A (FIG. 2*a*) that is relatively short, preferably less than the thickness 258A of the sintered polycrystalline diamond 261A. A cemented metal carbide substrate 260A having a thickness 256A less than the thickness 258A may reduce the potential bending moments experienced by the cemented metal carbide substrate 260A during operation, and therefore, reduce the stress on the interface 262A between the cemented metal carbide substrate 260A and sintered polycrystalline diamond 261A. In addition, the shorter thickness 256A may reduce the stress on the braze joint 263A that bonds the cemented metal carbide substrate 260A to the rotary portion 200A of the degradation assembly 101A.

The shank 204A, the cemented metal bolster 301A, and the cemented metal carbide substrate 260A preferably share a common central axis 255A.

The cemented metal bolster 301A is preferably wider at its base than the largest diameter of the substrate 260A. However, preferably at the braze joint 263A, a surface of the cemented metal carbide substrate 260A is slightly larger than a surface of the cemented metal carbide bolster 301A. This may allow the cemented metal carbide substrate 260A to overhang slightly. The overhang may be small enough that it is not visible after brazing because the braze material may extrude out filling the gap formed by the overhang. While an overhang as small as described may seem insignificant, improvement in field performance is contributed, in part, to it and is believed to further reduce stresses at the braze joint 263A.

Preferably, the cemented metal bolster 301A tapers from the interface 263A with the cemented metal carbide substrate 260A to a second interface 264A with a steel portion of the shield 201A. At the second interface 264A, another braze joint 253A (FIG. 2*a*) is relieved at the center with a small cavity 265A formed in the cemented metal bolster 301A. Also the thickness of the braze joint 253A increases closer to the periphery of the braze joint 253A, which is believed to help absorb impact loads during operation. Also, the steel of the shield 201A curves around a corner 252A (FIG. 2*a*) of the cemented metal bolster 301A at the second interface 264A to reduce stress risers.

The cemented metal bolster 301A tapers from the first interface 263A to the second interface 264A with a slightly convex form. The largest cross-sectional thickness of the cemented metal bolster 301A is critical because this thickness must be large enough to protect the steel of the shield 201A beneath it as well as spread the formation fragment apart for effective cutting.

In the prior art, the weakest part of a degradation assembly is generally the impact tip, which fail first. The prior art attempts to improve the life of these weaker impact tips by rotating the impact tips through a bearing usually located between the inner surface of a holder bore and the outer surface of a shank. This rotation allows different azimuths of the prior art impact tip 206 to engage the formation at each impact, effectively distributing wear and impact damage around the entire circumference of the tip.

The described combination of the cemented metal bolster 301A and the tip 206A have proven very successful in the field. Many of the features described herein are critical for a long-lasting degradation assembly 101A. In the present invention, the combination of the tip 206A and cemented metal bolster 301A is currently the most durable portion of the degradation assembly 101A. In fact, the tip 206A and the cemented metal bolster 301A are so durable that at present the applicants have not been able to create a bearing capable of outlasting this combination. In most cases, the bearing will fail before the tip 206A or cemented metal bolster 301A receives enough wear or damage sufficient to replace them. At present, the combination of the tip 206A and cemented metal bolster 301A is outlasting many of the commercially sold milling teeth by at least a factor of ten.

An advantage of the rotary portion 200A with a cemented metal bolster 301A and tip 206A that is substantially prevented from rotating during operation as described is an extended life of the overall degradation assembly 101A. Rotating the rotary portion 200A manually at predetermined times, or as desired, allows the wear to be distributed around the tip 206A and the cemented metal bolster 301A as well. The extended life of the degradation assembly 101A benefits operators by reducing down time to replace a worn degradation assembly 101A and reducing the inventory of replacement parts. The assemblies' longer life benefits operators by reducing down time to replace worn assemblies and reducing replace part inventories.

Figure 3A:
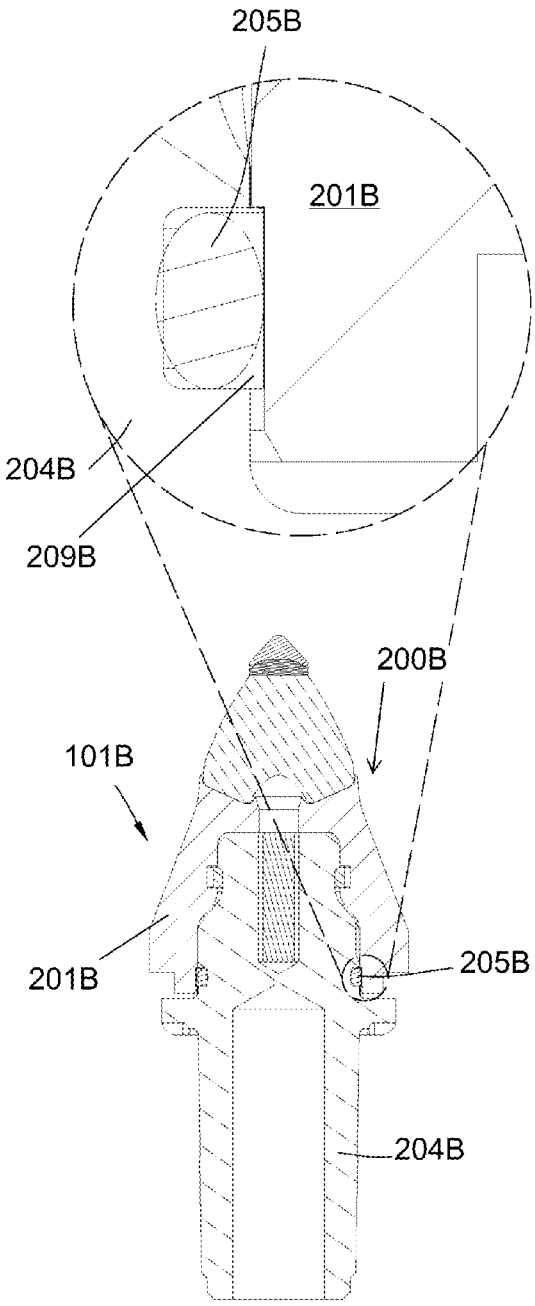
FIG. 3*a* is a cross-sectional diagram of another embodiment of a degradation assembly.

FIG. 3*a* is a cross-sectional diagram of another embodiment of a degradation assembly 101B that includes an O-ring 205B disposed between a shield 201B and a shank 204B within a recess or space 209B formed in the shank 204B. The O-ring 205B may still be under enough compression to substantially prevent rotation of a rotary portion 200B.

Figure 3B:
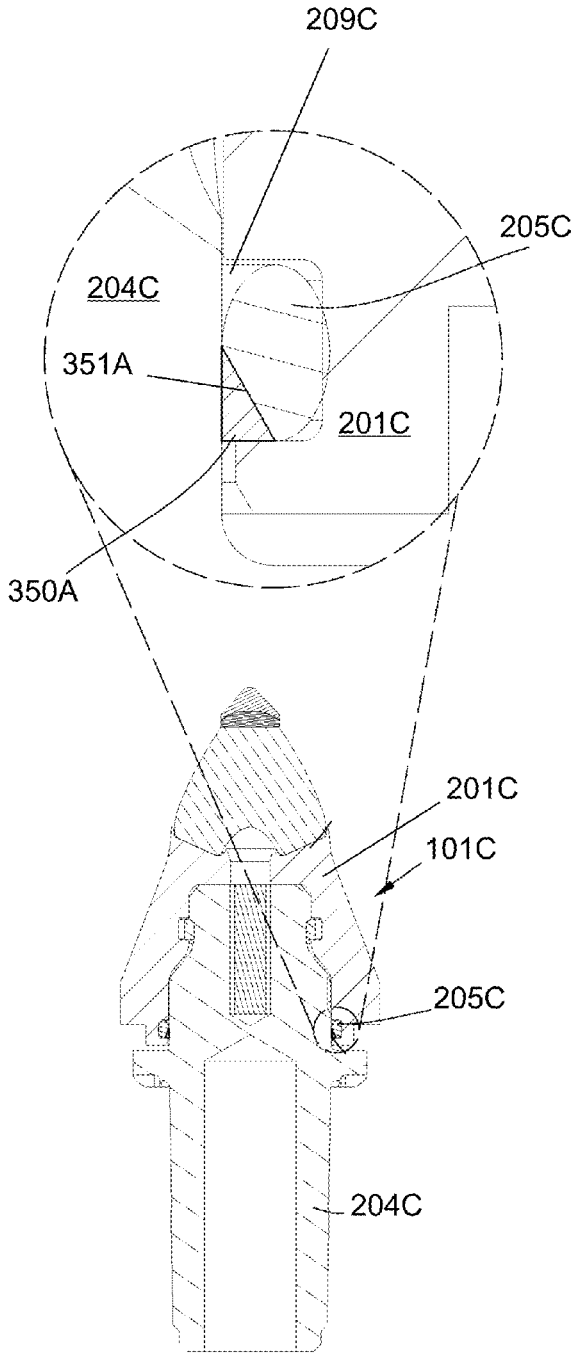
FIG. 3*b* is a cross-sectional diagram of another embodiment of a degradation assembly.

FIG. 3*b* discloses a cross-sectional diagram of another embodiment of a degradation assembly 101C that includes a back up 350A also disposed within a groove or space 209C in a shield 201C along with an O-ring 205C. The back-up 350A may comprise a metal ring with at least one substantially slanted surface 351A. The back-up 350A may be placed intermediate, or between, the O-ring 205C and a shank 204C. The back-up 350A may aid in compressing the O-ring 205C as well as protect the O-ring 205C during assembly.

Figure 4A:
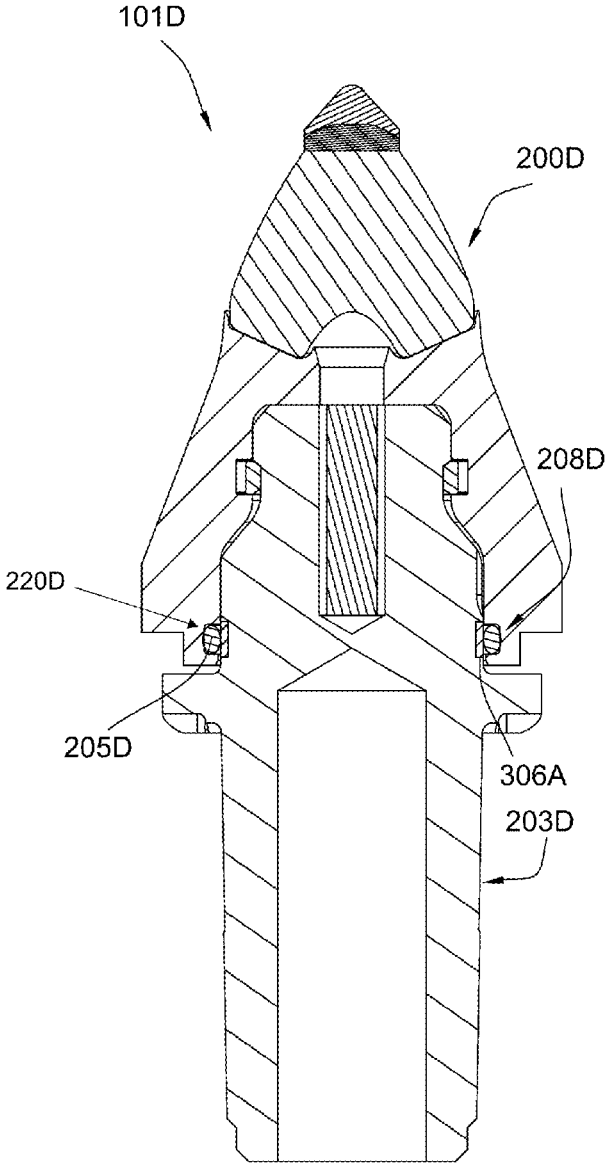
FIG. 4*a* is a cross-sectional diagram of another embodiment of a degradation assembly.

FIG. 4*a* discloses a cross-sectional diagram of another embodiment of a degradation assembly 101D that includes a rotary portion 200D, a stationary portion 203D, an indexing mechanism 220D, such as compressible element 208D like 0-ring 205D, and an additional compressive element 306A, such as an annular elastic element. The additional compressive element 306A may be disposed substantially within the stationary portion 203D adjacent the compressible element 208D, which is disposed within the rotary portion 200D. It is believed that the interaction between the additional compressive element 306A and the compressible element 208D may generate sufficient friction to prevent free rotation of the rotary portion 200D.

Figure 4B:
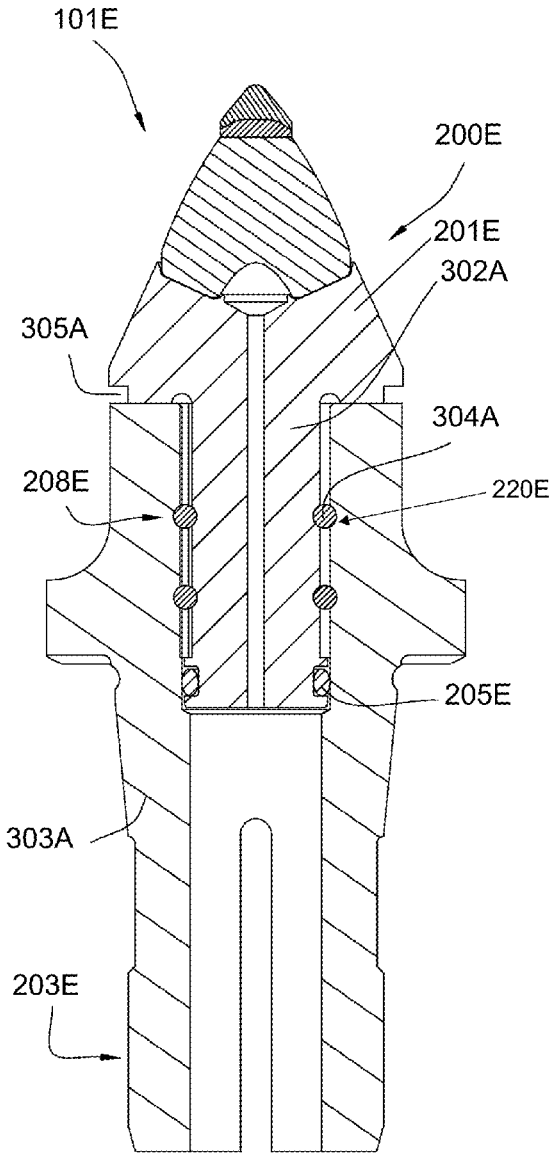
FIG. 4*b* is a cross-sectional diagram of another embodiment of a degradation assembly.

FIG. 4*b* discloses a degradation assembly 101E with a rotary portion 200E comprising a shield 201E that includes an integral shank 302A. A stationary portion 203E comprises a holder 303A with a bore adapted to rotationally support the integral shank 302A. An indexing mechanism 220E, such as compressible element 208E in the form of at least one rubber ball 304A is disposed intermediate, or between, the integral shank 302A and the holder 303A. The compressible element 208E alternatively may be an elastic ball, wedge, strip, block, square, blob, or combinations thereof. It is believed that the at least one rubber ball 304A may substantially prevent the rotation of a rotary portion 200E.

The degradation assembly 101E may also include an O-ring 205E disposed intermediate, or between, the integral shank 302A and the holder 303A. The O-ring 205E may function as a sealing element to retain lubricant within the degradation assembly 101E.

The degradation assembly 101E may also comprises a puller attachment 305A disposed on a shield 201E. The puller attachment 305A may be used to remove the rotary portion 200E of the degradation assembly 101E from the holder 303A.

Figure 5A:
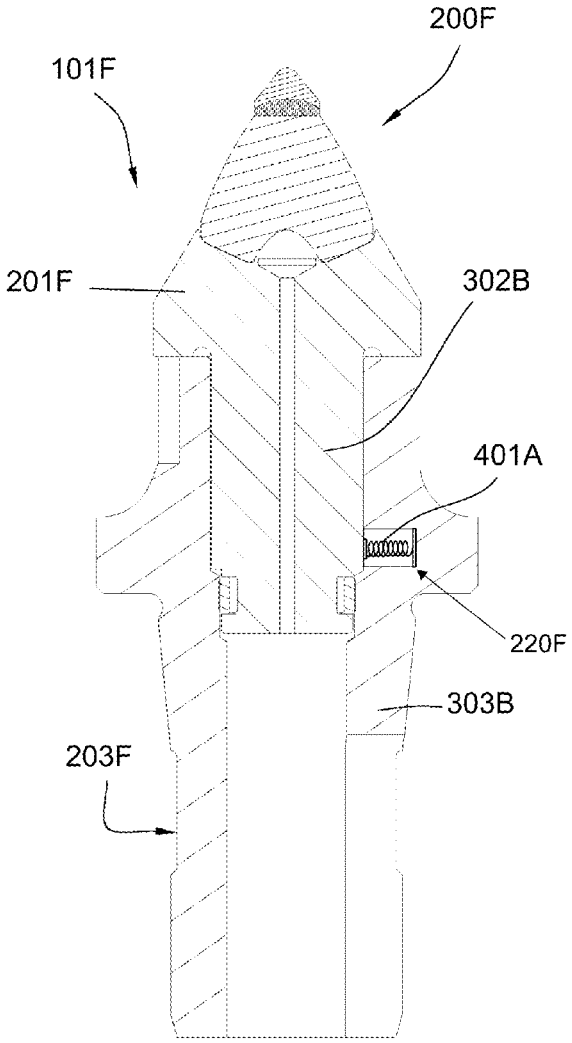
FIG. 5*a* is a cross-sectional diagram of another embodiment of a degradation assembly.

FIG. 5*a* discloses a cross-sectional diagram of another embodiment of a degradation assembly 101F that includes an indexing mechanism 220F, such as a compression spring 401A, disposed within a holder 303B of a stationary portion 203F, such that a portion of the spring 401A engages an integral shank 302B of a shield 201F of a rotary portion 200F. It is believed that the compression spring 401A may put enough pressure on the integral shank 302A to prevent free rotation of the rotary portion 200F.

Figure 5B:
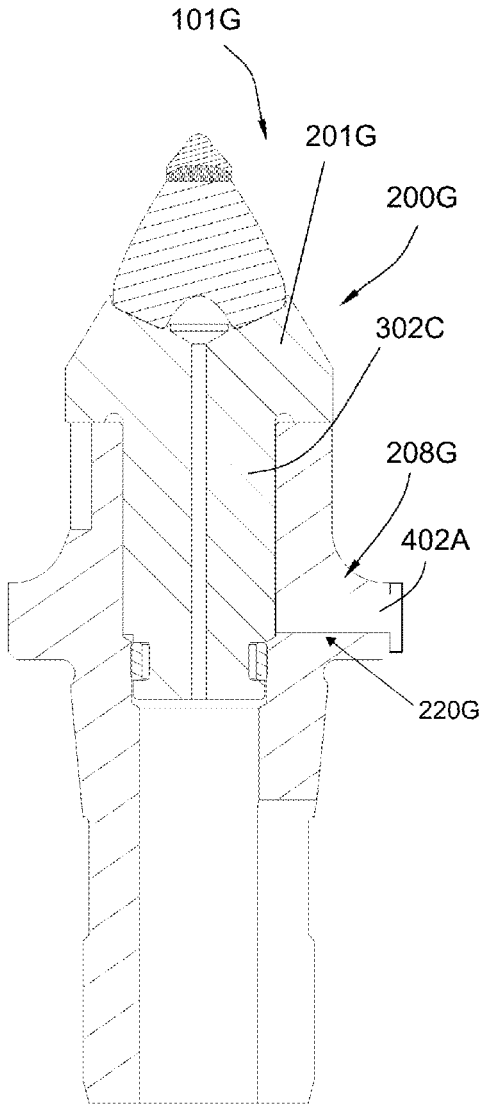
FIG. 5*b* is a cross-sectional diagram of another embodiment of a degradation assembly.

FIG. 5*b* discloses a cross-sectional diagram of another embodiment of a degradation assembly 101G that includes an indexing mechanism 220G, such as a press-fit pin 402A as a compressible element 208G. It is believed that the press-fit pin 402A is adjusted to put enough pressure on an integral shank 302C of a shield 201G of a rotary portion 200G to prevent free rotation of the rotary portion 200G.

Figure 6A:
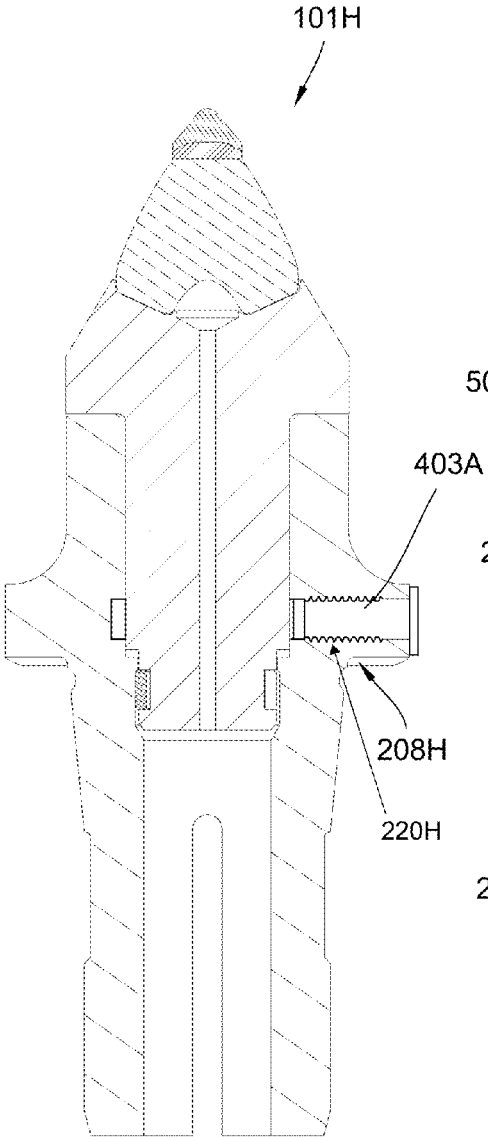
FIG. 6*a* is a cross-sectional diagram of another embodiment of a degradation assembly.

FIG. 6*a* discloses a cross-sectional diagram of another embodiment of a degradation assembly 101H that includes an indexing mechanism 220H, such as a set screw 403A as a compressible element 208H.

Figure 6B:
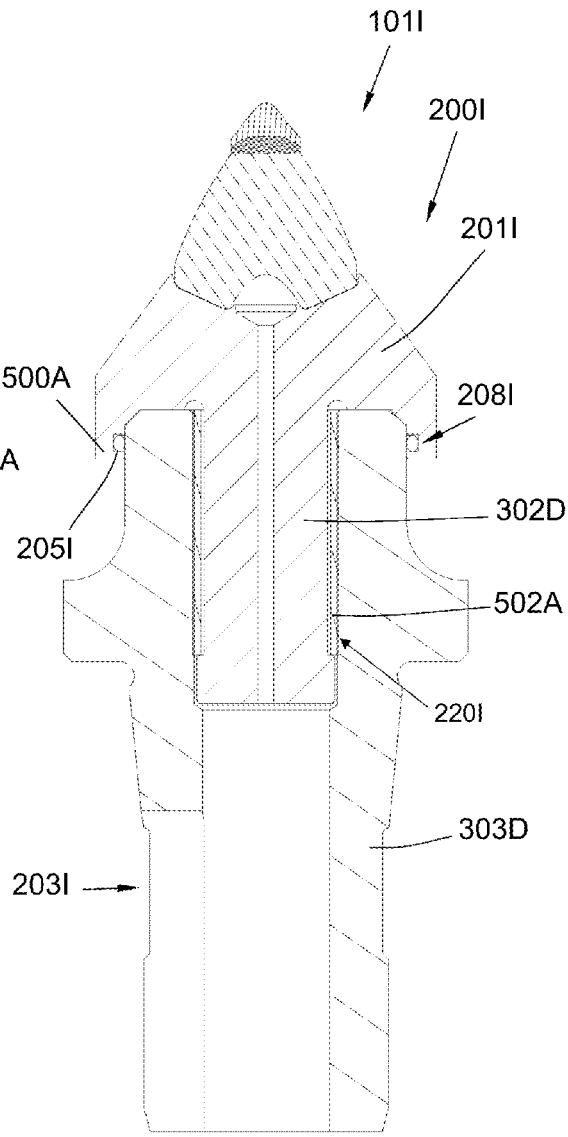
FIG. 6*b* is a cross-sectional diagram of another embodiment of a degradation assembly.

FIG. 6*b* discloses a cross-sectional diagram of another embodiment of a degradation assembly 101I that includes an outer edge 500A of a shield 201I of a rotary portion 200I that wraps around a portion of a holder 303D of a stationary portion 203I. The shield 201I includes an integral shank 302D. An indexing mechanism 2201, such as a compressible element 208I in the form of a compressed O-ring 205I is disposed between the outer edge 500 of the shield 201I and the holder 303D. The indexing mechanism 220I may also comprise a snap-ring 502A disposed intermediate, or between, the integral shank 302D and the holder 303D. The snap-ring 502A may prevent the rotary portion 200I from separating from the stationary portion 203I.

Figure 7:
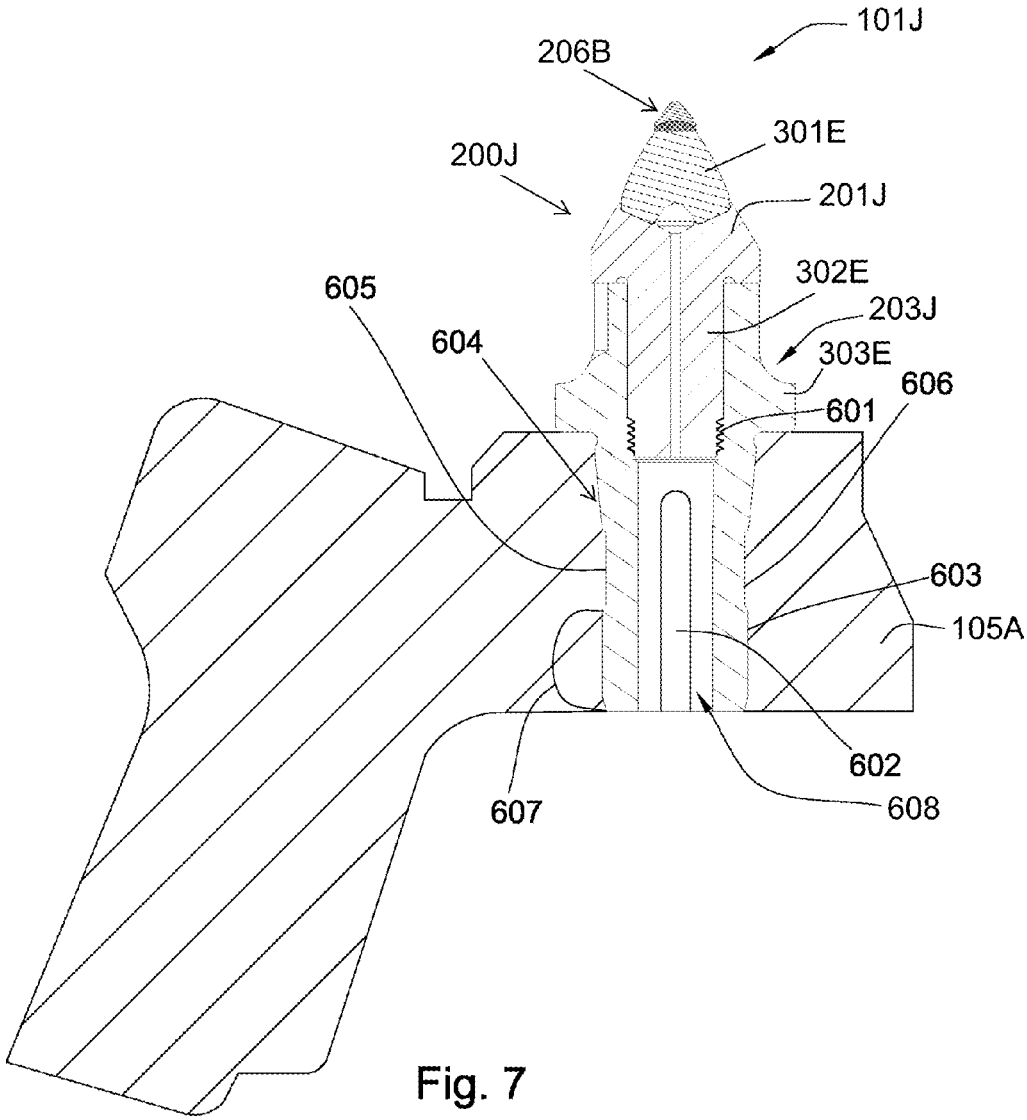
FIG. 7 is a cross-sectional diagram of another embodiment of a degradation assembly.

FIG. 7 discloses a degradation assembly 101J disposed within a holder 303E and a block 105A. A rotary portion 200J of the degradation assembly 101 J comprises a cemented metal bolster 301E and a shield 201J that includes an integral shank 302E and the holder 303E. The cemented metal bolster 301E and the shield 201J are affixed to each other. A conical diamond impact tip 206B is bonded to the cemented metal bolster 301E. The integral shank 302E is in mechanical communication with the holder 303E through a threadform 601.

The block 105A comprises a bore 604 with a neck 605 where the bore 604 narrows. The holder 303E may comprise a groove 606 adapted to receive the neck 605 of the bore 604 and a compressible element 608 in the form of at least one slot 602 formed within the holder 303E. It is believed that the at least one slot 602 may allow the holder 303E to temporarily compress to allow the holder 303E to squeeze past the neck 605 within the bore 604 of the block 105A until the neck 605 is seated within the groove 606.

After the neck 605 has been seated in the groove 606, a portion 607 of the holder 303E that includes the slot 602 may occupy a portion of the bore 604 that has a circumference that is smaller than the natural circumference of the portion 607 of the holder 303E. This may cause the portion 607 of the holder 303E to exert an outward force onto the inner wall 603 of the bore 604. It is believed that the force exerted by the portion 607 of the holder 303E onto the inner wall 603 of the bore 604 may prevent the degradation assembly 101J from freely rotating but allow for manual rotation of the degradation assembly 101J.

Figure 8A:
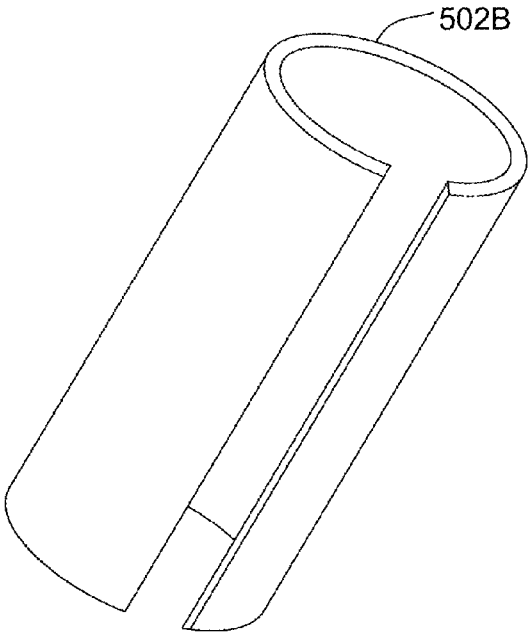
FIG. 8*a* is a perspective view of an embodiment of a snap ring.
Figure 8B:
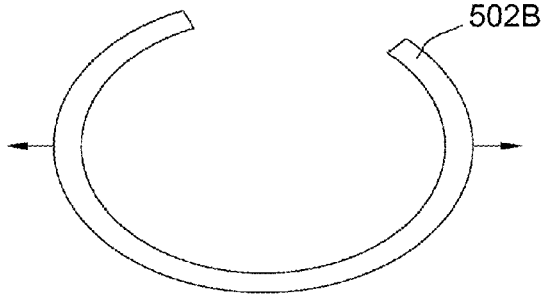
FIG. 8*b* is a top view of an embodiment of a snap ring.

FIGS. 8*a*-8*d* disclose different embodiments of snap-rings and spring clips, such as the spring clip 202A (FIGS. 2*a* and 2*b*) and snap-ring 502A (FIG. 6*b*) that may be used as an indexing mechanism, such as a compressible element to prevent free rotation of a rotary portion of a degradation assembly, as discussed above, while still allowing for manual rotation. FIGS. 8*a* and 8*b* disclose a snap-ring 502B with an oval shape. When the snap-ring is disposed intermediate, or between, a shank and a holder, such as the holder 303D in FIG. 6*b*, the oval shape of the snap-ring 502B is forced into a circular shape causing a portion of the snap-ring 502B to collapse onto the shank and holder preventing the free rotation of the rotary portion as discussed above.

Figure 8C:
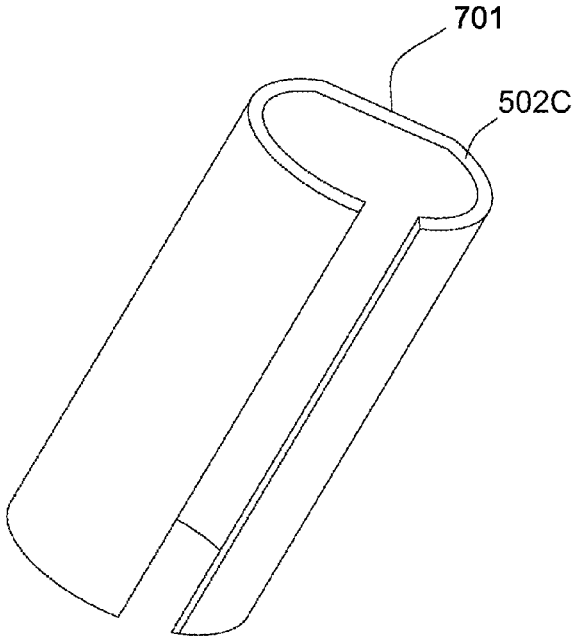
FIG. 8*c* is a perspective view of another embodiment of a snap ring.
Figure 8D:
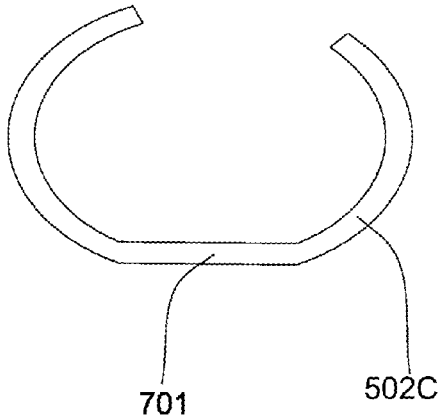
FIG. 8*d* is a top view of another embodiment of a snap ring.

FIGS. 8*c* and 8*d* disclose a snap-ring 502C with at least a flat side 701. The flat side 701 may also prevent free rotation of the rotary portion of the degradation assembly by collapsing on both the shank and the holder.

Figure 9A:
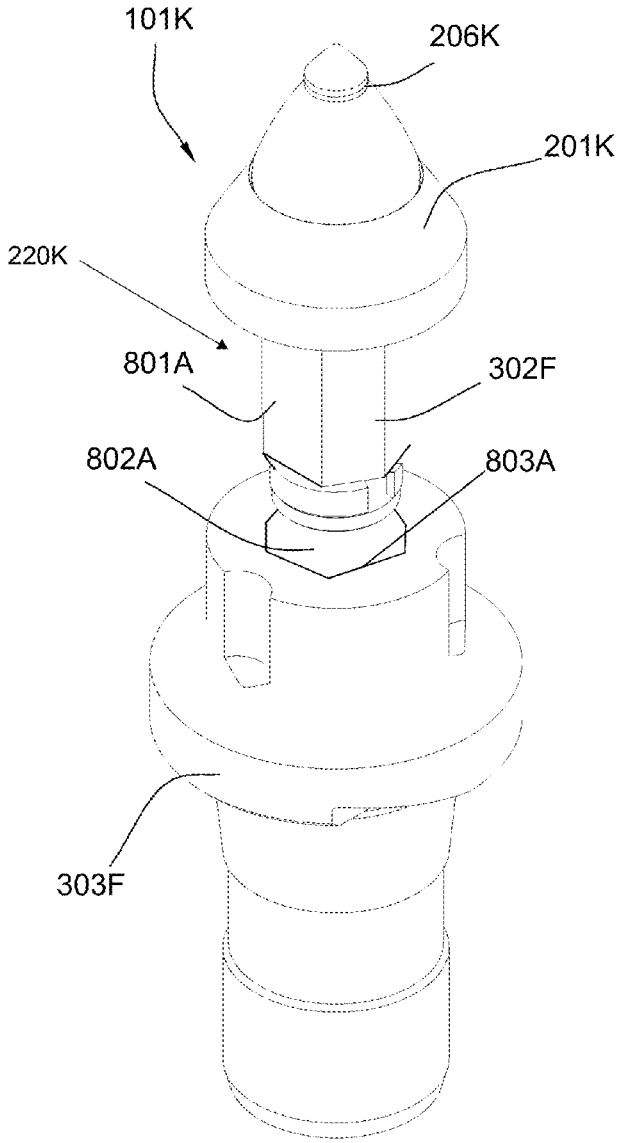
FIG. 9*a* is a cross-sectional diagram of another embodiment of a degradation assembly.
Figure 9B:
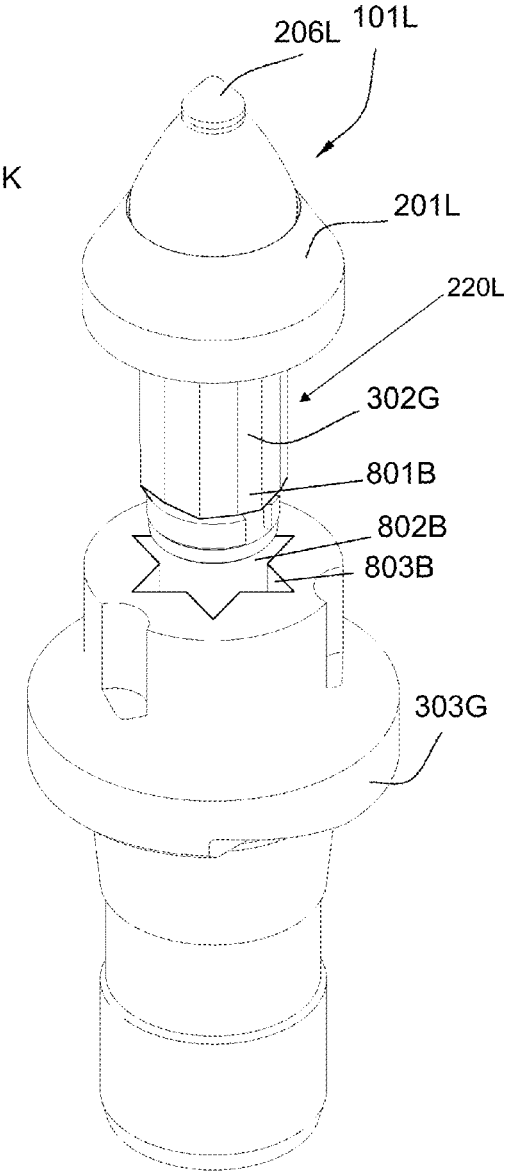
FIG. 9*b* is a cross-sectional diagram of another embodiment of a degradation assembly.

FIGS. 9*a* and 9*b* disclose rotationally indexable degradation assemblies. FIG. 9*a* discloses a degradation assembly 101K that includes a holder 303F with a bore 802A. An integral shank 302F of a shield 201K comprises in indexing mechanism 220K, such as longitudinal surfaces 801A complementary to surfaces 803A formed in the bore 802A. FIG. 9*a* discloses that the integral shank 302F has a hexagonal shape. The bore 802A in the holder 303F comprises a corresponding hexagonal shape of substantially the same proportions as the integral shank 302F. The integral shank 302F is adapted to be inserted into the bore 802A of the holder 303F in six different orientations due to the hexagonal shape of the integral shank 302F. Each of the different positions may orient a different azimuth of a tip 206K towards a working surface during operation. As one indexed azimuth of the tip 206K begins to wear, the tip 206K may be rotated to distribute the wear of the tip 206K to another azimuth.

FIG. 9*b* discloses a degradation assembly 101L that includes a holder 303G with a bore 802B. An integral shank 302G of a shield 201L comprises an indexing mechanism 220L, such as longitudinal surfaces 801B complementary to surfaces 803B formed in the bore 802B. FIG. 9*b* discloses that the integral shank 302G has a star shape. The bore 802B in the holder 303G comprises a corresponding star shape of substantially the same proportions as the integral shank 302G. The integral shank 302G is adapted to be inserted into the bore 802B of the holder 303G in multiple different orientations due to the star shape of the integral shank 302G. Each of the different positions may orient a different azimuth of a tip 206L towards a working surface during operation. As one indexed azimuth of the tip 206L begins to wear, the tip 206L may be rotated to distribute the wear of the tip 206L to another azimuth. This shape would allow for multiple azimuthal positions of the conical diamond tip 206L.

Figure 10A:
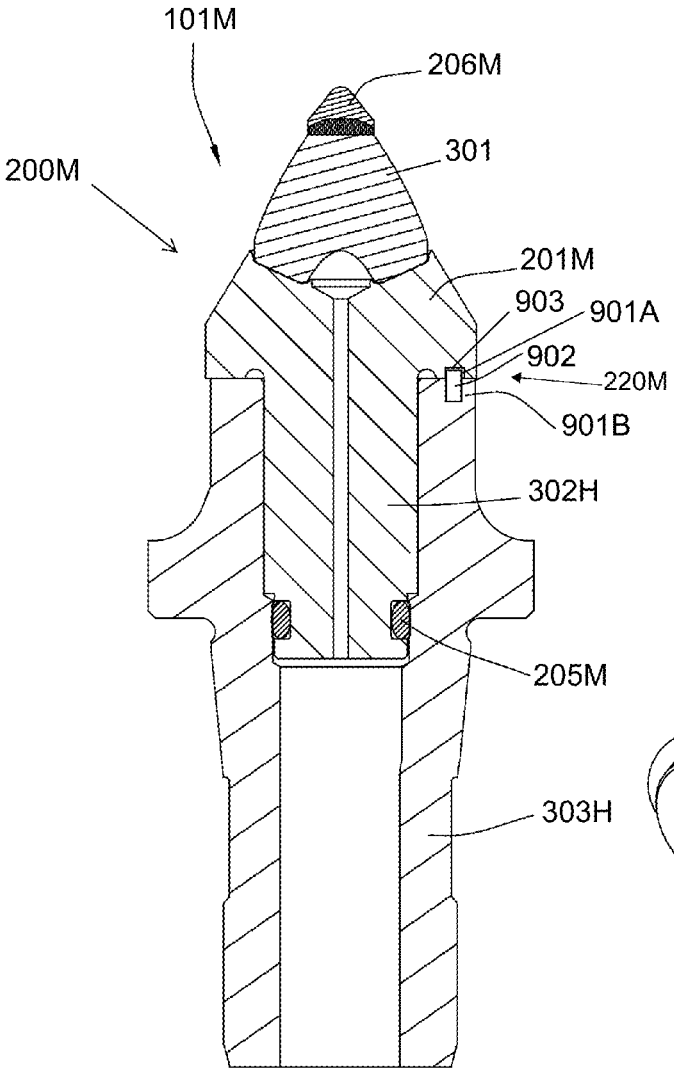
FIG. 10*a* is a cross-sectional diagram of another embodiment of a degradation assembly.
Figure 10B:
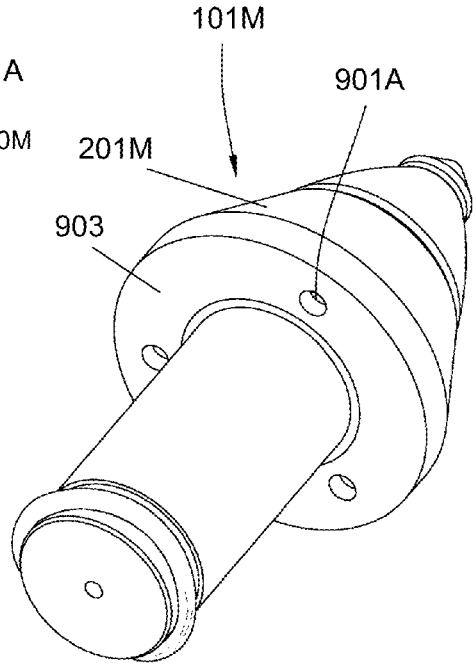
FIG. 10*b* is a perspective view of a diagram of another embodiment of a degradation assembly.

FIGS. 10*a* and 10*b* disclose a rotationally indexable degradation assembly 101M. A rotary portion 200M includes a cemented metal bolster 301H is intermediate, or between, a conical diamond tip 206M and a shield 201M that includes an integral shank 302H. An O-ring 205M may be disposed around the integral shank 302H. The integral shank 302H may be disposed within a holder 303H.

A side 903 of the shield 201M opposite the conical diamond tip 206M may comprise circumferentially equally spaced holes 901A. These holes 901A may be adapted to receive interlocking elements 902, such as press-fit pins, to form an indexing mechanism 220M. The holder 303H may comprise corresponding holes 901B adapted to receive interlocking elements 902.

The degradation assembly 101M may be used in degradation operations until the conical diamond tip 206M begins to show uneven wear, at which time the rotary portion 200M may be detached from the holder 303H by pulling the holder 303H and the shield 201M away from each other, thereby causing the interlocking elements 902, such as press-fit pins, to come out of the holes 901A or 901B. The rotary portion 200M may then be rotated until another set of holes 901A and 901B align, the interlocking elements 902 are reinserted, and then the shield 201M may be pressed onto the holder 303H. In some embodiments, the interlocking elements are integral to with the stationary or rotary portions of the assembly.

Figure 11A:
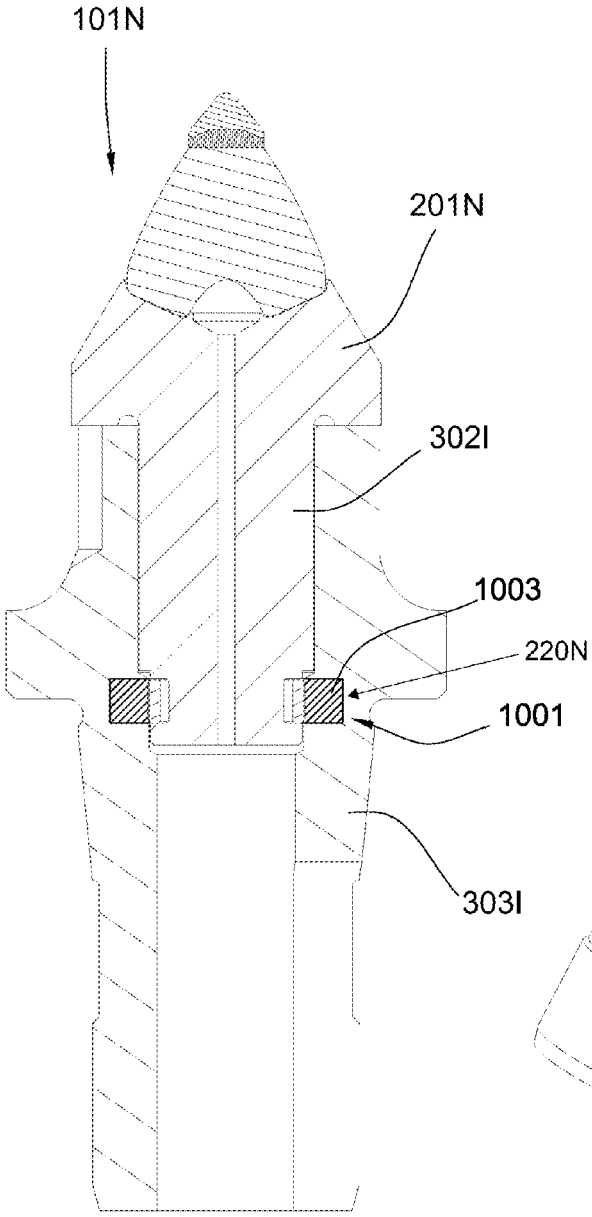
FIG. 11*a* is a cross-sectional diagram of another embodiment of a degradation assembly.
Figure 11B:
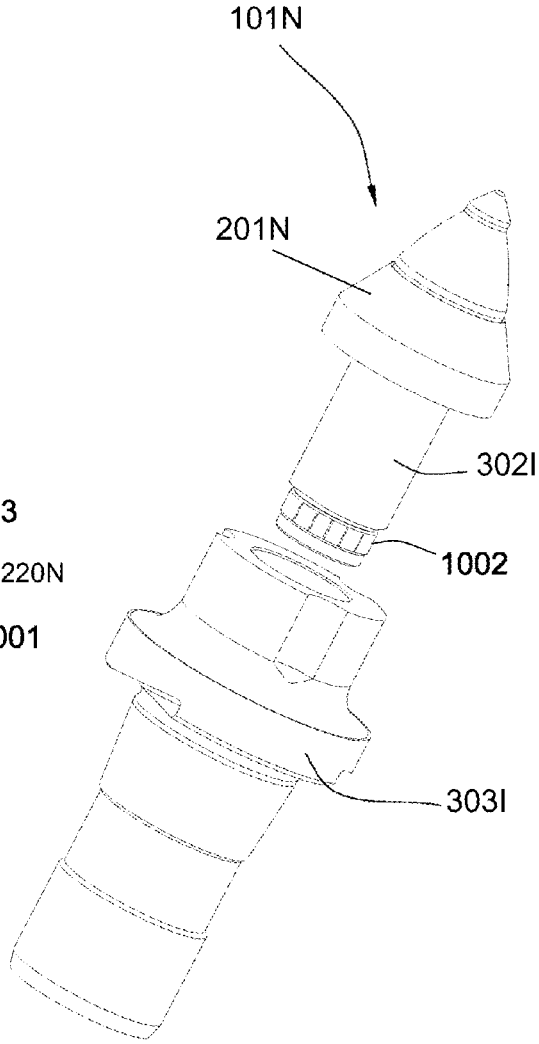
FIG. 11*b* is a perspective view of a diagram of another embodiment of a degradation assembly.

FIGS. 11*a* and 11*b* discloses a degradation assembly 101N that includes an indexing mechanism 220N, such as a ratcheted cam system 1001 with a set of indexable teeth 1002, disposed around an integral shank 302I of a shield 201N. A holder 303I may comprise a tab, or catch 1003 adapted to interface with the indexable teeth 1002 on the integral shank 302I. The tab 1003 and the indexable teeth 1002 may interact in such a way that allows for the integral shank 302 to rotate in a single direction. The tab 1003 may also interfere with the single direction of rotation sufficiently to prevent free rotation of the integral shank 302I while in use.

Figure 12A:
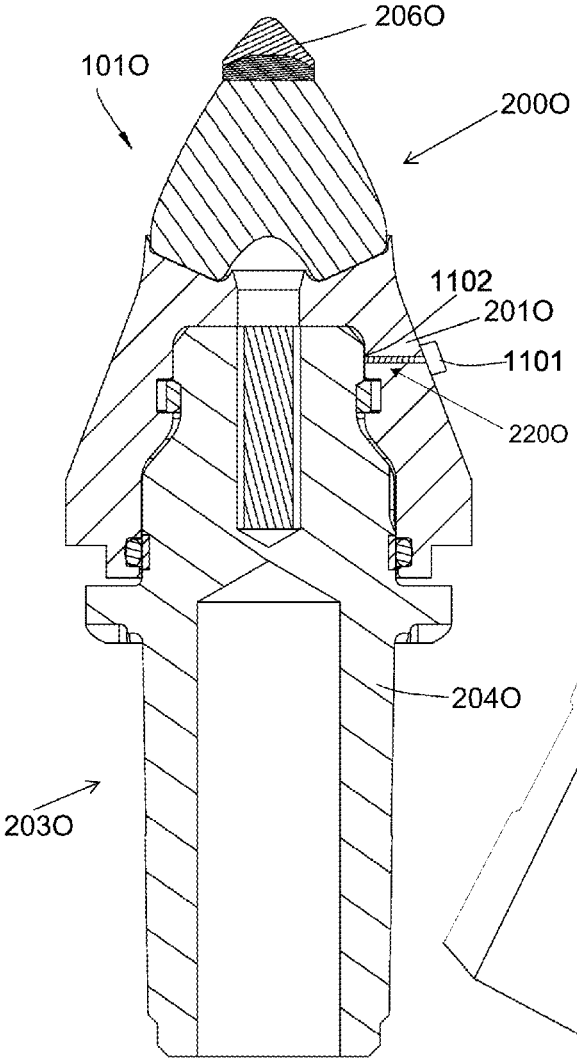
FIG. 12*a* is a cross-sectional diagram of another embodiment of a degradation assembly.

FIG. 12*a* discloses a degradation assembly 101O that includes a rotary portion 200O. The rotary portion 200O includes a conical diamond tip 206O and a shield 201O. A stationary portion 2030 of the degradation assembly 1010 may comprise a shank 204O. The shank 204O may comprise an indexing mechanism 220O, such as equally circumferentially spaced flat surfaces 1102 adapted to receive a set screw 1101. As a conical diamond tip 206O begins to wear, the set screw 1101 may be loosened, the shield 201Q rotated, and the set screw 1101 reset.

Figure 12B:
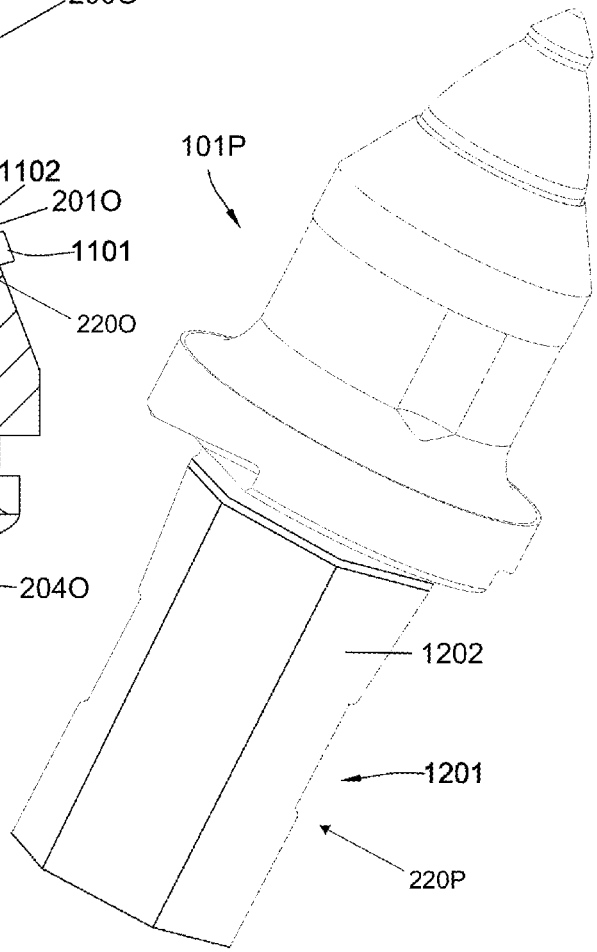
FIG. 12*b* is a cross-sectional diagram of another embodiment of a degradation assembly.

FIG. 12*b* discloses a degradation assembly 101P that includes an indexing mechanism 220P, such as a holder 1201 that comprises axial flats 1202. In this embodiment, the holder 1201 comprises a hexagonal shape. When the degradation assembly 101 begins to show uneven wear the holder 1201 may be removed from a block, rotated, and then reinserted.

Figure 13:
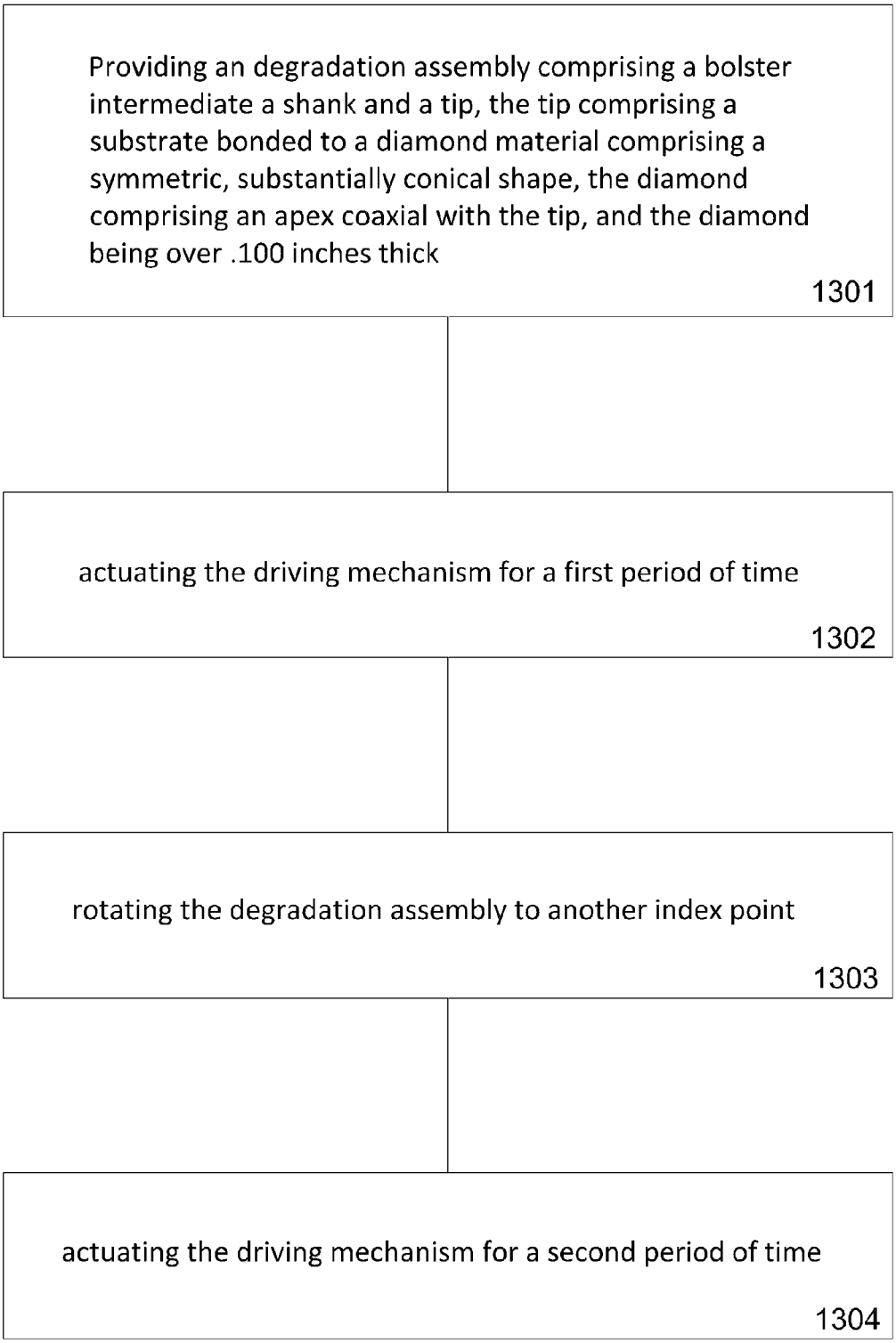
FIG. 13 is a flow chart of an embodiment of a method for manually rotating a degradation assembly.

FIG. 13 is a flow chart of a method for rotating a degradation assembly to another index point to lengthen the life of the degradation assembly. The steps include step 1301 of providing a degradation assembly comprising a bolster intermediate, or between, a shank and a tip, the tip comprising a substrate bonded to a diamond material comprising a substantially conical shape, the diamond comprising an apex coaxial with the tip, and the diamond being over 0.100 inches thick. Step 1302 includes using the degradation assembly by actuating the driving mechanism for a first period of time. Step 1303 involves stopping the driving mechanism and rotating the degradation assembly to another index point once the degradation assembly shows enough wear. In step 1304, the degradation process is restarted by actuating the driving mechanism for a second period of time 1304.

Whereas the present invention has been described in particular relation to the drawings attached hereto, it should be understood that other and further modifications apart from those shown or suggested herein, may be made within the scope and spirit of the present invention.

What is claimed is:

1. A degradation tool assembly, comprising:

a rotary portion comprising:

a bolster and an impact tip bonded to the bolster;

a shield having a recess;

a stationary portion comprising:

a block adapted to couple to the rotary portion and further adapted to couple to a drive mechanism;

a shank having a first end, the recess of the shield being rotatably connected to the first end of the shank, and a second end spaced apart from the first end, the second end of the shank adapted to be secured within the block; and a compressible element disposed between and in mechanical contact with the rotary portion and the stationary portion, the rotary portion and the stationary portion compressing the compressible element sufficiently to prevent free rotation of the rotary portion relative to the stationary portion during a degradation operation.

2. The degradation tool assembly of claim 1, wherein the compressible element is an O-ring under 20 percent to 40 percent compression.

3. The degradation tool assembly of claim 1, wherein the compressible element is an O-ring of 70 durometers to 90 durometers.

4. The degradation tool assembly of claim 1, wherein the compressible element is an O-ring.

5. The degradation tool assembly of claim 1, wherein the compressible element is a seal that retains lubricant between the rotating portion and the stationary portion.

6. The degradation tool assembly of claim 1, wherein the rotary portion has a puller attachment.

7. The degradation tool assembly of claim 1, wherein the rotary portion has a wrench flat.

8. The degradation tool assembly of claim 1, wherein the compressible element includes at least one rubber ball disposed in a cavity between the stationary portion and the rotary portion.

9. The degradation tool assembly of claim 1, wherein the compressible element is a non-round spring clip.

10. The degradation tool assembly of claim 9, wherein the spring clip has at least one substantially flat surface.

11. The degradation tool assembly of claim 1, wherein the stationary portion includes a holder.

12. The degradation tool assembly of claim 1, wherein the assembly further comprises a back-up adjacent to the O-ring.

13. A degradation tool assembly, comprising:

a rotary portion comprising a bolster and an impact tip bonded to the bolster;

a stationary portion comprising a block adapted to couple to the rotary portion and further adapted to couple to a drive mechanism; and a compressible element disposed between and in mechanical contact with the rotary portion and the stationary portion, the rotary portion and the stationary portion compressing the compressible element sufficient to prevent free rotation of the rotary portion relative to the stationary portion during a degradation operation;

wherein the compressible element is comprised of a first rubber compressible element disposed on the stationary portion and a second rubber compressible element disposed on the rotary portion, the first rubber compressible element being in contact with the second rubber compressible element.

* * * * *